United States Patent [19]

Seaton

[11] Patent Number: 4,902,011

[45] Date of Patent: Feb. 20, 1990

[54] MAGNETIC GAME APPARATUS

[76] Inventor: Douglas D. Seaton, 482 Wellington St. W., Toronto, Ontario, Canada, M5V 1E3

[21] Appl. No.: 220,436

[22] Filed: Jul. 13, 1988

[30] Foreign Application Priority Data

Oct. 17, 1986 [CA] Canada ..... 520721

[51] Int. Cl.[4] ..... A63B 9/00

[52] U.S. Cl. ..... 273/1 GD; 446/129

[58] Field of Search ..... 273/1 GD, 1 GF, 1 M, 273/239; 446/129, 133, 137

[56] References Cited

U.S. PATENT DOCUMENTS

| | | | |
|---|---|---|---|
| 3,207,960 | 9/1965 | MacDougal | 446/129 X |
| 3,307,850 | 3/1967 | Thomas | 446/137 X |
| 3,556,526 | 1/1971 | Currie | 273/239 |
| 3,799,548 | 3/1974 | Lemkin | 273/1 M X |
| 3,830,498 | 8/1974 | Lauzon | 446/138 X |
| 4,211,411 | 7/1980 | McDaniel et al. | 273/239 X |

FOREIGN PATENT DOCUMENTS

| | | | |
|---|---|---|---|
| 2281776 | 3/1976 | France | 446/133 |
| WO85/00528 | 2/1985 | PCT Int'l Appl. | 273/239 |

OTHER PUBLICATIONS

H. Fishlove & Co. advertising circular, 3-1965, Space Trix.

*Primary Examiner*—Paul E. Shapiro
*Attorney, Agent, or Firm*—Arne I. Fors

[57] ABSTRACT

A game apparatus which utilizes a plurality of magnetized playing pieces is disclosed. The magnetized playing pieces are in the shape of two-sided circular discs, one side having a north polarity and other side a south polarity. The common polarities are identified by a surface color or by indicia printed thereon.

The playing pieces are displayed on a flat, horizontal playing surface, preferably within a circular boundary on a rough-textured surface such as provided by canvas, leather or etched glass. The pole strengths of the magnetic playing pieces are sufficient to permit the balancing of a playing piece obliquely on its edge in proximity to but spaced from a flat-lying piece of like upward-facing polarity.

3 Claims, 1 Drawing Sheet

MAGNETIC GAME APPARATUS

This application is a continuation of application Ser. No. 921,492 filed Oct. 22, 1986 (now abandoned).

BACKGROUND OF THE INVENTION

This invention relates to a game apparatus and, more particularly, relates to a game apparatus which utilizes magnetized playing pieces on a playing surface.

Games which make use of magnetized playing pieces are known. For example, U.S. Pat. No. 4,013,293 issued Mar. 22, 1977 and U.S. Pat. No. 4,021,042 issued May 3, 1977 disclose magnetized game boards having array of locations, such as playing squares or pockets, which have randomly selected magnetic polarities.

British Patent Specification No. 1,109,898 published Apr. 18, 1968 discloses a game apparatus in which magnetic playing pieces have trunion projections for permitting altering of the positions of the pieces during the play of the game by making use of magnetic lines of force. This game apparatus necessitates a rigid and relatively complex multi-platform construction to make use of the magnetic lines of force.

STATEMENT OF INVENTION

In its broad aspect, the magnetic game apparatus of the present invention comprises a planar, playing surface having a predetermined boundary defining a playing area, and a plurality of two-sided magnetic playing pieces in the shape of circular discs having a north polarity on one side of each disc and a south polarity on the opposite side of said disc, each of said discs having means for identifying the said north and south polarities.

More particularly, the pole strengths of said magnetic playing pieces are sufficient to permit the balancing of one playing piece obliquely on an edge against the magnetic field of an adjacent but spaced-apart flat-lying playing piece of like upward facing polarity.

BRIEF DESCRIPTION OF THE DRAWING

The magnetic game apparatus of the invention will now be described with reference to the accompanying drawing, in which.

DESCRIPTION OF THE PREFERRED EMBODIMENT

The game apparatus of the present invention includes a flat playing area 10 preferably defined by a circular boundary 12 printed or embossed on a planar surface or sheet 14 on which play of the game is to be conducted. The playing area preferably has a somewhat rough or textured surface 15, for reasons which will become apparent as the description proceeds, such as provided by the relatively rough underside of a leather sheet or by a canvas sheet, etched surface of a glass plate, textured wood, plywood, paper board or the like.

Figure 1:
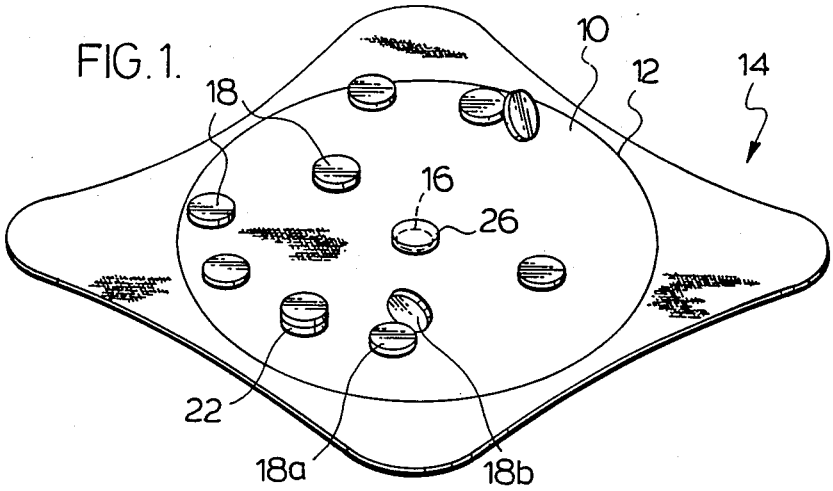
FIG. 1 is a perspective view of the playing surface of the invention having magnetic playing pieces positioned in the playing area during play of the game.

In the embodiment illustrated in FIG. 1, a leather sheet 14 is shown to be substantially rectangular in shape with the circular boundary 12 and a central dot or circle 16 drawn or printed thereon.

Figure 2:
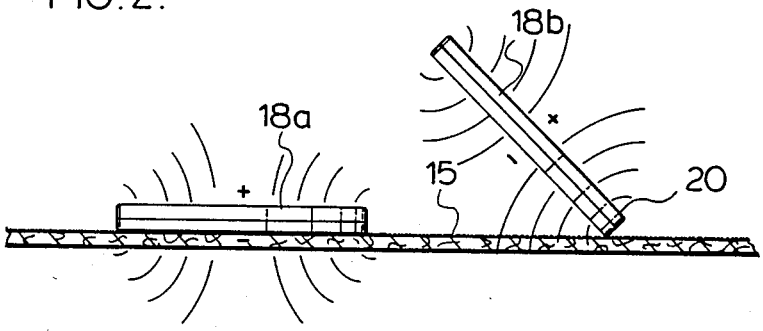
FIG. 2 is a side elevation of a pair of the magnetic playing pieces showing a playing piece in its balanced position.

A plurality of a magnetic playing piece 18 is provided for play of the game on the playing surface. Each of the magnetic playing pieces comprises a thin, permanently magnetic circular disc having north and south polarities on opposite sides thereof with the magnetic axes of the discs perpendicular to their faces, as shown most clearly in FIG. 2. The pole strengths of the magnetic fields of said magnetic discs is sufficient such that adjacent but judiciously, i.e. skillfully, spaced-apart pieces are sufficiently mutually repelled to permit the balancing of one playing piece obliquely on an edge against gravity within the magnetic field of a flat-lying piece of like upward facing polarity.

Figure 3:
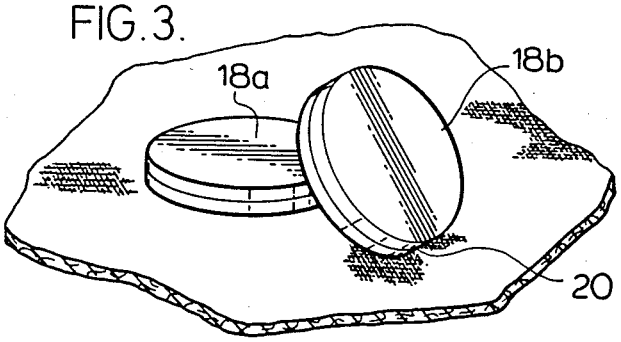
FIG. 3 is a perspective view of the pair of magnetic playing pieces illustrated in FIG. 2.

Suitable magnetized playing pieces are formed in the shape of two-sided circular discs of an iron particulate dispersed in a ceramic matrix or in a polyvinyl chloride matrix each having a north polarity (i.e. north seeking polarity) on one side of the disc and a south polarity (i.e. south seeking polarity) on the opposite side of the disc. Accordingly, and with particular reference to FIGS. 2 and 3, the positioning of a playing piece **18*a* with its north pole up and its south pole down on the playing area creates a magnetic force field around piece 18*a* as typified in FIG. 2. The careful positioning of a playing piece 18*b*, with a like north polarity facing upwardly, obliquely on an edge 20 in proximity to playing piece 18*a* can result in balancing of piece 18*b* on its edge 20 against gravity within the magnetic field of piece 18*a* such that piece 18*b* remains balanced stationary on its said edge until influenced by external magnetic forces due to the presence of other magnetic pieces in proximity thereto. A slightly rough or textured surface 15 is desirable in order to prevent piece 18*b*** from freely sliding or rotating on its edge when placed within the playing area.

A degree of skill by a player is required for the successful balancing of piece **18*b* in proximity to and against the magnetic force field of piece 18*a* in that placement of piece 18*b* too far from piece 18*a* results in piece 18*b* falling flat on its south pole surface or placement of piece 18*b* too close to piece 18*a* results in piece 18*b* being drawn to piece 18*a* because of the attraction of opposite poles. If the latter result occurs, piece 18*b* suddenly combines with piece 18*a* to form a coupled unit having mutually co-extensive edges lying on a side as depicted by numeral 22** orlying on edge, not shown.

The magnetic field strengths of the magnetic pieces is also sufficient such that improper balancing of a piece in proximity to another or balancing of a piece too close to another can result in the pieces joining together by mutual attraction of opposite poles so suddenly and with such force that one or both pieces can be propelled into the air from the playing surface to join each other. The coupled discs may subsequently fall flat onto the playing surface with either polarity upwards or may come to rest on the playing surface in an upright position on their said mutually co-extensive edges.

The polarities of the magnetic fields produced by the pieces are identified by markings such as indicia or by surface colours to distinguish the north polarity from the south polarity. In accordance with an embodiment of the rules of the game, a magnetic playing piece having a distinctive colour and bearing indicia such as a painted bar (north) or dot (south) is tossed like a coin to determine the fundamental polarity of the field, i.e. either north or south, and the player who wins the toss chooses the polarity of his playing pieces. For example, the north polarity may be coloured black and the south polarity coloured white. The player who wins the toss chooses his colour, usually opposite to the fundamental polarity of the field.

The magnetic playing piece 26 bearing a distinctive colour and indicia is then placed in the center of the playing field on dot or circle 16 with the fundamental polarity as determined by the toss in the upward position. Physical contact between the center magnetic piece 26 and the pieces in play is prohibited and the discs may not be balanced against the said central magnetic piece 26.

Each player, or team of players, deploys several magnetic pieces of his polarity (e.g. five pieces) about the field within the circular boundary with each player's designated polarity in the upward position. Alternate moves then commence with each player normally taking a turn at balancing a magnetic piece obliquely on its edge in the magnetic field of a similarly coloured flat-lying magnetic piece. Once a piece is successfully balanced, it is left in that position and the opponent takes a turn.

Disruption of the positions of magnetic pieces already in play, such as a when a player brings a magnetic piece into the field of play and causes a previously balanced magnetic piece to fall to the surface, or to cause two or more pieces to contact each other, may determine the next move by the player and/or result in a change in score. For example, the eventual positions assumed by the magnetic pieces as a result of the disruption due to the player's move determine points for or against the player depending on the exposed polarity of the piece or pieces which have been disrupted and the final position of a column, i.e. combination of two or more magnetic pieces into a column, with a polarity upwards or with the column on its side.

It will be understood, of course, that modifications can be made in the embodiment of the invention illustrated and described herein without departing from the scope and purview of the invention as defined in the appended claims.

I claim:

1. A magnetic game consisting, in combination, of, a planar playing surface having a predetermined boundary defining a playing area, a surface location marked on said playing surface, a first set of a plurality of imperforate magnetic playing pieces each in the shape of a two sided circular disc and having a north polarity on one side and a south polarity on the other side, a second set consisting of a single imperforate magnetic playing piece in the shape of a two sided circular disc and having a north polarity on one side and a south polarity on the other side said single playing piece being marked to distinguish said single playing piece from the first set of playing pieces, and intended to be seated on said surface location, said planar surface being provided by a rough-textured surface selected from a surface from the group consisting of the surfaces of a leather sheet, canvas sheet, plastics sheet, etched glass plate, plywood and paper board, and said first set of playing pieces and said second set of a single piece having means for identifying the said north and south polarities and having sufficient pole strengths for balancing of a playing piece obliquely on its edge in proximity to but spaced from a flat-lying, unrestrained disc of like upward-facing polarity randomly located within the playing area.

2. A magnetic game as claimed in claim 1 in which said magnetic playing pieces are formed of a dispersion of iron particulate in a matrix selected from the group consisting of a ceramic and polyvinyl chloride matrix.

3. A magnetic game as claimed in claim 1 in which said magnetic playing pieces are each coloured black on one side and white on the opposite side to identify north and south polarities respectively.

* * * * *